US005473782A

United States Patent [19]

Coakley

[11] Patent Number: 5,473,782

[45] Date of Patent: Dec. 12, 1995

[54] GARBAGE DISPOSAL GUARD AND PLUNGER

[75] Inventor: William J. Coakley, 730 Twinview Pl., Pleasent Hill, Calif. 94523

[73] Assignee: William J. Coakley, Pleasent Hill, Calif.

[21] Appl. No.: 944,802

[22] Filed: Sep. 14, 1992

Related U.S. Application Data

[63] Continuation-in-part of Ser. No. 649,738, Feb. 1, 1991, abandoned.

[51] Int. Cl.[6] ..... A47K 1/14

[52] U.S. Cl. ..... 4/295; 15/105

[58] Field of Search ..... 4/286, 295; 15/105

[56] References Cited

U.S. PATENT DOCUMENTS

| | | | |
|---|---|---|---|
| 2,329,242 | 9/1943 | Best | 4/295 |
| 2,869,794 | 1/1959 | Modrey | 4/295 X |
| 3,780,393 | 12/1973 | Gaetke | 15/105 |
| 4,232,407 | 11/1980 | Williams | 4/287 |
| 4,268,080 | 5/1981 | Lindley | 294/1 R |
| 4,297,761 | 11/1981 | Loos | 15/105 |
| 4,395,792 | 8/1983 | Cosner | 15/105 |
| 4,409,692 | 10/1983 | Ness | 4/286 |
| 4,504,996 | 3/1985 | Loos | 15/105 |
| 4,745,642 | 5/1988 | Shands | 15/105 X |

*Primary Examiner*—Henry J. Recla
*Assistant Examiner*—Robert M. Fetsuga

[57] ABSTRACT

An improved garbage disposal cap for scraping waste from eating wear and sinks that allows safe insertion of waste into the disposal unit. The improved garbage disposal cap is equipped with circular shape which may be constructed of sponge or other materials. Waste is scraped from eating wear and sink and pushed into the disposal unit. The improved disposal cap further acts as a drain cap by pushing the plunger portion thru the disposal and the cap portion sealing over the top of the splash guard. The invention further acts as a disposal guard by resting the scraper-plunger portion on the splash guard with the cap of the invention at sink level allowing for normal use of the sink and water flow.

2 Claims, 3 Drawing Sheets

GARBAGE DISPOSAL GUARD AND PLUNGER

This application is a continuation-in-part of application Ser. No. 07/649,738, filed Feb. 1, 1991, now abandoned.

BACKGROUND—FIELD OF INVENTION

This invention relates to garbage disposal caps and stoppers also known as drain plugs.

BACKGROUND—DISCUSSION OF PRIOR ART

Heretofore garbage disposal caps have been limited to capping off the disposal unit and allowing water to fill the sink. The problem that yet remains is the safe insertion of waste into the disposal unit. This is currently done by forcing the waste by utensil or hand into the disposal unit both of which may cause serious injury to the operator.

OBJECTS AND ADVANTAGES

Accordingly several objects and advantages of the invention are as follows: To provide a garbage disposal cap capable of safe insertion of waste into the disposal unit. To provide a garbage disposal cap capable of scraping waste from eating-wear and sink prior to disposal. To also provide a garbage disposal cap that guards the disposal when not in use from accidental insertion of utensils etc. Further objects and advantages of the invention will be apparent from a study of the following portions of the specification.

DRAWING FIGURES

DRAWING REFERENCE NUMERALS

10 cap

14 neck

16 scraper-disk

18 handle

20 fingers

DESCRIPTION OF THE INVENTION

Figure 1:
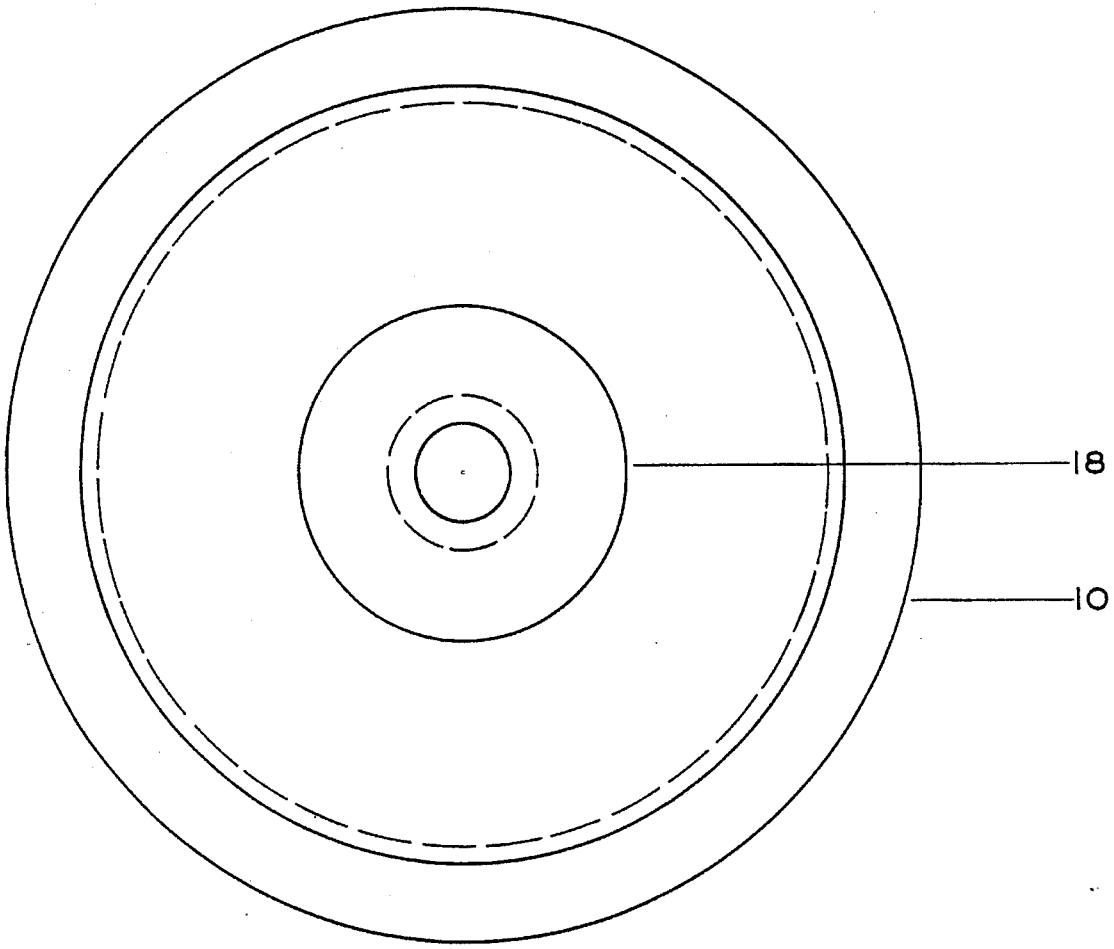
FIG. 1 shows a top view of the disposal cap with parts removed for clarity.
Figure 2:
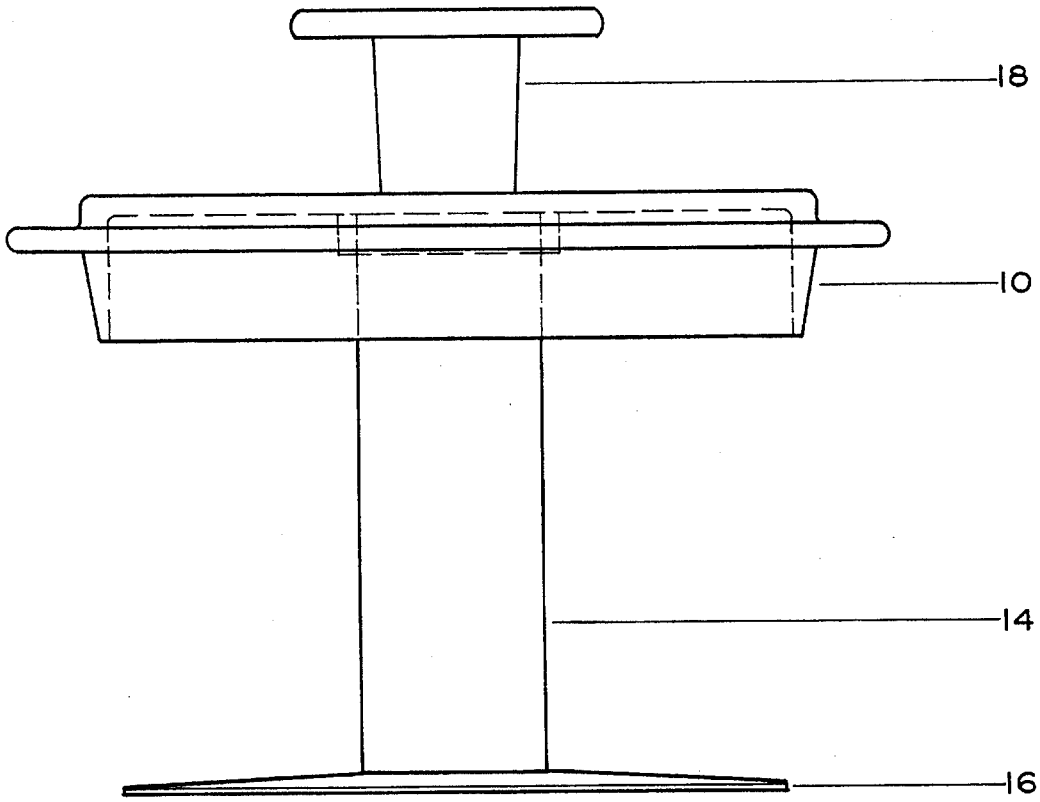
FIG. 2 shows a front view of the disposal cap.
Figure 3:
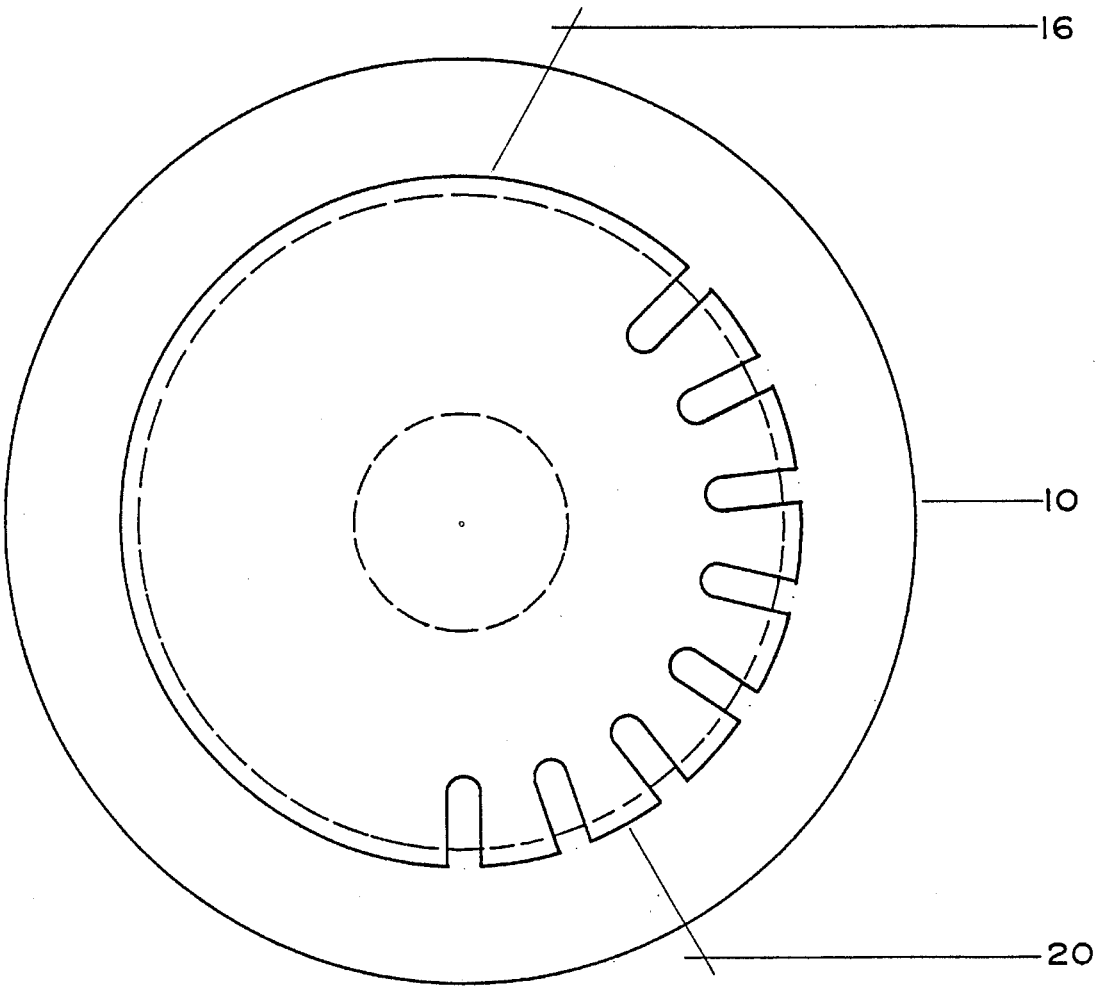
FIG. 3 shows a sectional view of the disposal cap taken along line 3—3 of FIG. 2.

FIGS. 1 through 3 show the embodiment of the present invention. The garbage disposal guard and plunger is preferably made from plastic and is rigid as needed and flexible as well. The plastic best found for this purpose is known as PVC and when mixed 75 percent flexible with 25 percent rigid material the invention is rigid at the top portion and flexible at the bottom portion.

The garbage disposal guard and plunger has a handle 18 which inserts through a center hole in the cap 10 and into a hollow chamber 12 of the neck 14. The cap includes a skirt 22 depending from the undersurface thereof and encircling the center hole therethrough to receive the neck 14. The neck continues into the scraper-disk portion 16 of the invention as best seen in FIG. 2.

Fingers 20 comprise approximately one half of the scraper-disk 16 as illustrated in FIG. 3.

The embodiment is of three pieces and is glued together with PVC glue which melts the plastic together and makes the invention impermeable to water.

OPERATION OF THE INVENTION

The garbage disposal guard and plunger of FIG. 2 has several functions,including scraping food and waste particles from eating-ware and sink, plunging said waste safely into the disposal unit, safe guarding the disposal unit from accidental insertion of utensils and other unwanted objects, operating as an ordinary drain cap.

To scrape food and waste particles the invention is grasped by handle 18 and a sweeping and or scraping motion is made with the bottom portion of the invention 16.

To plunge waste the handle 18 is grasped and food waste is pushed through the splash guard into the disposal unit with the bottom portion of the invention 16 scraper-disk.

To guard the disposal unit from accidental insertion of utensils and other unwanted objects the invention is placed with the scraper-disk 16 standing upright upon the splash guard of the disposal unit. Fingers 20 of FIG. 3 allow normal water flow while the cap 10 of FIG. 1 is positioned above to block unwanted objects from entering the disposal unit.

To operate as a drain cap the scraper-disk 16 is pushed through the splash guard of the disposal unit and the cap 10 seals against the splash guard allowing the sink to fill with water.

The above description of a three piece construction of the invention made with plastic is best conceived by the inventor to produce a cost efficient product.

While the above description has many specifies, these should not be construed as limitations on the scope of the invention, but rather as an exemplification of one preferred embodiment thereof.

Many other variations are possible. For example skilled artisans will readily be able to change the dimensions and shapes of the various embodiments.

They will also be able to make the invention of alternative materials such as metal and rubber.

Alternative embodiments include a garbage disposal guard construed as one single piece or replaceable attachments of various types for the scraper-disk portion of the invention.

Accordingly, the scope of the invention should be determined not by the embodiments illustrated, but by the appended claims and their legal equivalents.

What is claimed is:

1. A garbage disposal guard and plunger for use with a sink drain mounted garbage disposal unit having a splash guard, comprising:

a handle for being grasped by a user;

a substantially circular cap for sealing the sink drain and for guarding against unwanted items entering the garbage disposal unit; and, a neck and scraper portion having an elongate cylindrical neck with a disk mounted perpendicular to the longitudinal axis on one end thereof, said disk being sized to fit within the sink drain;

said cap being mounted to the other end of said neck between said neck and said handle;

whereby, said disk either may be supported on the splash guard of the garbage disposal unit with said cap located thereabove wherein said cap guards against the unwanted items entering the garbage disposal unit or may be pushed through the splash guard wherein the cap may seal the sink drain, and said disk may be manipulated by said handle to serve as a scraper or to push garbage through the splash guard and into the garbage disposal.

2. The garbage disposal guard and plunger of claim 1, wherein said disk includes spaced-apart fingers formed therein to facilitate water flow past the disk.

* * * * *